US007408103B2

(12) United States Patent
Wachter

(10) Patent No.: US 7,408,103 B2
(45) Date of Patent: Aug. 5, 2008

(54) CYMBAL MUTING SYSTEM

(76) Inventor: Martin Richard Wachter, 2107 Sulgrave Ave., Baltimore, MD (US) 21209

( * ) Notice: Subject to any disclaimer, the term of this patent is extended or adjusted under 35 U.S.C. 154(b) by 187 days.

(21) Appl. No.: 11/129,919

(22) Filed: May 16, 2005

(65) Prior Publication Data

US 2005/0257663 A1 Nov. 24, 2005

Related U.S. Application Data

(60) Provisional application No. 60/572,537, filed on May 19, 2004.

(51) Int. Cl.
*G10D 13/02* (2006.01)

(52) U.S. Cl. ..... 84/411 M

(58) Field of Classification Search ..... 84/411 M, 84/422.1, 422.3, 422.2
See application file for complete search history.

(56) References Cited

U.S. PATENT DOCUMENTS

| | | | | |
|---|---|---|---|---|
| 4,037,509 | A | 7/1977 | Slomovits | |
| 4,244,266 | A * | 1/1981 | Hardy | 84/411 M |
| 4,290,332 | A * | 9/1981 | Schoeffling, Jr. | 84/723 |
| 5,561,254 | A | 10/1996 | Huffer | |
| 5,959,227 | A | 9/1999 | Shapiro | |
| 6,686,528 | B1 | 2/2004 | Dicken | |
| 6,720,491 | B1 * | 4/2004 | Kroncke | 84/422.3 |
| 2006/0065099 | A1 * | 3/2006 | Anderson | 84/411 M |

* cited by examiner

*Primary Examiner*—Kimberly R Lockett
(74) *Attorney, Agent, or Firm*—Max Stul Oppenheimer

(57) ABSTRACT

A percussion cymbal instrument is muted by using a dampening layer to reduce the sound and acoustic vibrations when struck. In a preferred embodiment, the muting system is comprised of a layer of flexible plastic adhered to a cymbal surface. When the cymbal is struck, the muting system dissipates the normal vibrations of the cymbal without hampering the natural look, feel, playability, or natural swinging motion of the cymbal.

1 Claim, 6 Drawing Sheets

CYMBAL MUTING SYSTEM

This application is entitled to, and claims the benefit of, priority from U.S. Provisional Application Ser. No. 60/572,537, filed May 19, 2004.

FIELD AND BACKGROUND OF THE INVENTION

1. Field of the Invention

The present invention relates in general to percussion instruments, and more particularly to a novel method for muting the sound of a metal acoustic cymbal.

2. Background Information

Percussion cymbal instruments are a class of musical percussion instruments having a playing (usually upper) surface and a second (usually lower) surface, that are played by striking the playing surface with a stick or other implement, to produce a spectrum of sound caused by the vibrations of the cymbal.

The playing surface could be made from almost any material, although most percussion cymbal manufacturers use some type of metal alloy which is molded or die cut into various shapes and sizes, typically formed as a round disc with a mounting hole in the center. The mounting hole in the center permits the cymbal to be mounted centrally on a stand, allowing the cymbal to remain balanced. When struck, the cymbal will vibrate and swing on the stand in order to create its unique sound.

The purposes of muting the vibrations from a percussion cymbal instrument include A) reducing the sound level to allow playing or practicing without generating the full sound level and B) reducing direct acoustical sound when the cymbal is used as an electronic cymbal trigger, used to convert vibrations into electronic signals, so as to avoid interference with the electronically generated sound.

I provide here, a system for reducing the vibrations and muting the natural sounds of a percussion cymbal instrument.

The ideal design for a cymbal muting system would permit the cymbal to retain its normal characteristics (natural look, feel, playability, and natural swinging motion) while reducing the audible sound vibrations which occur when struck.

Current systems may cause the cymbal to become unbalanced and cumbersome to operate. Muting devices mounted on the playing surface of the cymbal change look, feel, and stick response of the instrument. Unbalanced striking surfaces require additional mechanisms to prevent the striking surface from unintentionally rotating and tipping over. The natural swinging motion of the cymbal may be reduced or eliminated Some devices result in the cymbals no longer looking like real cymbals. For examples of problems in the prior art, see U.S. Pat. Nos. 5,959,227 and 6,686,528 (which require cumbersome additional hardware), U.S. Pat. No. 5,959,227 (which requires the use of unbalanced devices mounted on the top playing surface of the cymbal), U.S. Pat. No. 6,686,528 (which reduces the natural swinging motion), and U.S. Pat. Nos. 4,037,509 and 5,561,254 (which change the color and appearance of the cymbal).

SUMMARY OF THE INVENTION

I have invented a better device for reducing the vibrations of percussion cymbal instruments.

The muting system comprises a flexible, preferably plastic, dampening layer and an adhesive layer to bond the flexible layer to the second surface of the cymbal. The plastic layer may comprise a centrally located hole in the center to permit the pass through or a typical mounting device or cymbal stand. The plastic layer can cover the entire second surface of the cymbal (save the mounting hole) or a portion of it. Ideally, the plastic layer would be the same outside diameter as the cymbal in order to maximize the dampening effect.

The adhesive layer is applied to one side of the plastic layer and then is bonded to the second surface of the cymbal. Means are provided for proper adhesion of the plastic layer to the metal surface of the cymbal as to allow easy removal and reuse of the muting system or a permanent bond, depending on the user's preference.

In accordance with another feature of the present invention, the flexible plastic layer can be made from a clear plastic material, allowing the natural color of the cymbal to be visible through the plastic muting layer. This layer provides a protective coating on the second surface of the cymbal, thus not affecting the playability or aesthetics of the playing surface. Although many materials could be used to provide this layer, I used a plasticized flexible PVC (polyvinyl chloride). The clear PVC plastic layer allows the second surface of the cymbal to appear unaffected as the natural surface of the cymbal is allowed to show through the clear layer.

In general I have found that 0.080" and 0.060" layers are preferable because they are a) readily available sizes b) not too thin as to limit the amount of vibration reduction, and c) not too thick as to change the weight and natural playability of the cymbal.

The vibration dampening device may be a ring-shaped gasket, which is preferably thick enough to limit the vibratory response of the cymbal, is transparent and does not change the balance of the cymbal when bonded to the cymbal. A suitable material is Poly Vinyl Chloride (PVC).

The advantages of my invention over previously invented vibration dampening systems include the following:

- It requires no additional mechanical devices to mute the sound.
- It allows the striking surface to remain balanced.
- It can be utilized with any cymbal striking surface including conventional metal cymbals.
- The clear plastic layer allows the natural color and shine of the original cymbal to show through.
- It is easy to apply and remove or it can be permanently attached.
- It can be used with standard cymbals and stands.
- It does not modify the playing surface.
- It allows the playing surface to exhibit natural playing characteristics such as free rotation, proper swing, and natural stick response.

The objects of my invention are:

- To provide a cymbal muting device that does not interfere with the natural playing surface of a cymbal.
- To provide a cymbal muting device that does not interfere with the natural balance of a cymbal.
- To provide a cymbal muting device that maintains the natural color and aesthetics of the cymbal.
- To provide a cymbal muting device that can be retrofitted onto existing cymbals.
- To provide a cymbal muting device that allows permanent or temporary modification of a cymbal.

BRIEF DESCRIPTION OF THE DRAWINGS

The foregoing and still other objects of this invention will become apparent, along with various advantages and features of novelty residing in the present embodiments, from study of the following drawings, in which.

DETAILED DESCRIPTION OF THE PREFERRED EMBODIMENT

A clear flexible PVC ring shaped device is attached to the underside of a cymbal using an adhesive that allows a bond of metal and PVC plastic. The clear PVC layer provides the dampening or muting effect by limiting the vibratory response of the cymbal while also allowing the natural surface of the cymbal to show through the transparent PVC material, thus a cymbal with my device attached will appear to have no device attached at all, but will have a limited vibratory response.

Figure 1:
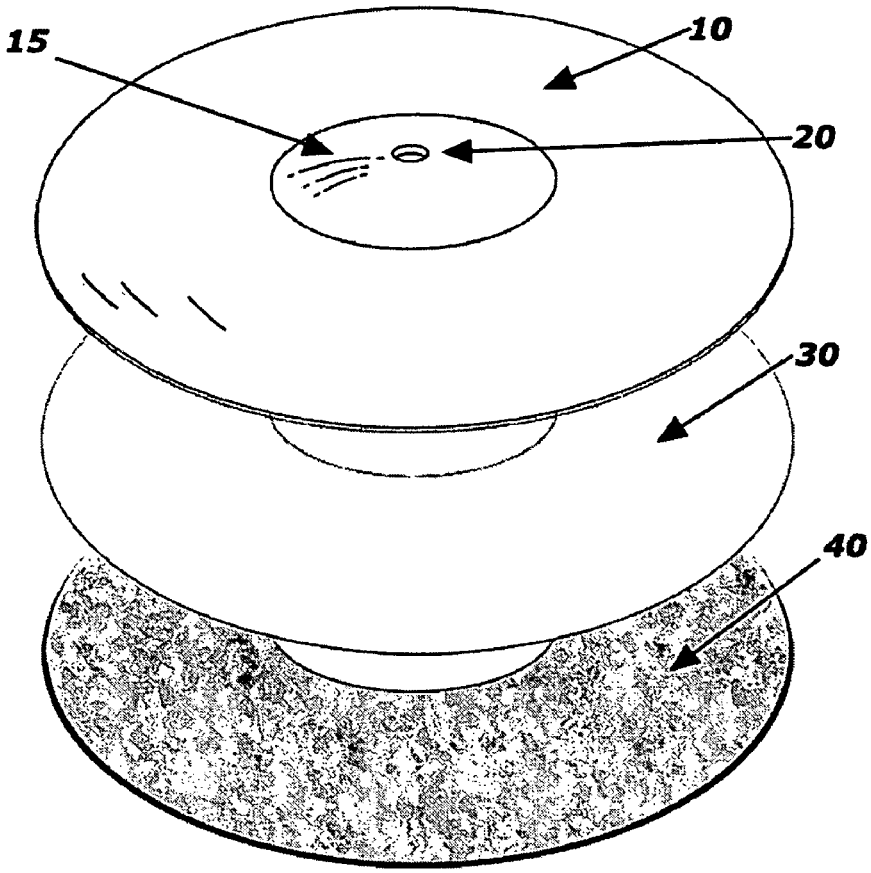
FIG. 1 is an exploded view of the cymbal muting system.

The components that make up my invention are as follows:

FIG. 1 shows a brass alloy cymbal 10 with a half-inch hole in the center 20 and a bell 15. The hole 20 located at the center of the bell 15, allows the cymbal to be centrally mounted by standard means known to those of ordinary skill in the art. A ring shaped layer of clear flexible PVC material 40 is bonded to the underside of the cymbal 10 by a thin layer of clear two-sided pressure sensitive adhesive 30. A 0.08 inch PVC material 40 with an outside dimension equal to that of the cymbal 10, inside dimension of the PVC material 40 equal to the diameter of the cymbal's bell 15 and 2 mil clear acrylic two-sided pressure sensitive adhesive has proved satisfactory.

Figure 2:
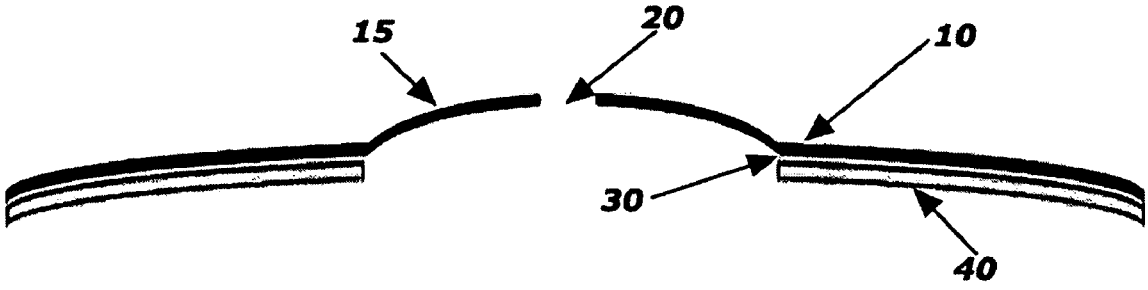
FIG. 2 is a cross section view from the side of the cymbal muting system.

FIG. 2 shows a cross section view of the cymbal 10 with the hole 20 and the bell 15. The adhesive layer 30 is sandwiched between the cymbal 10 and the PVC ring 40.

Figure 3:
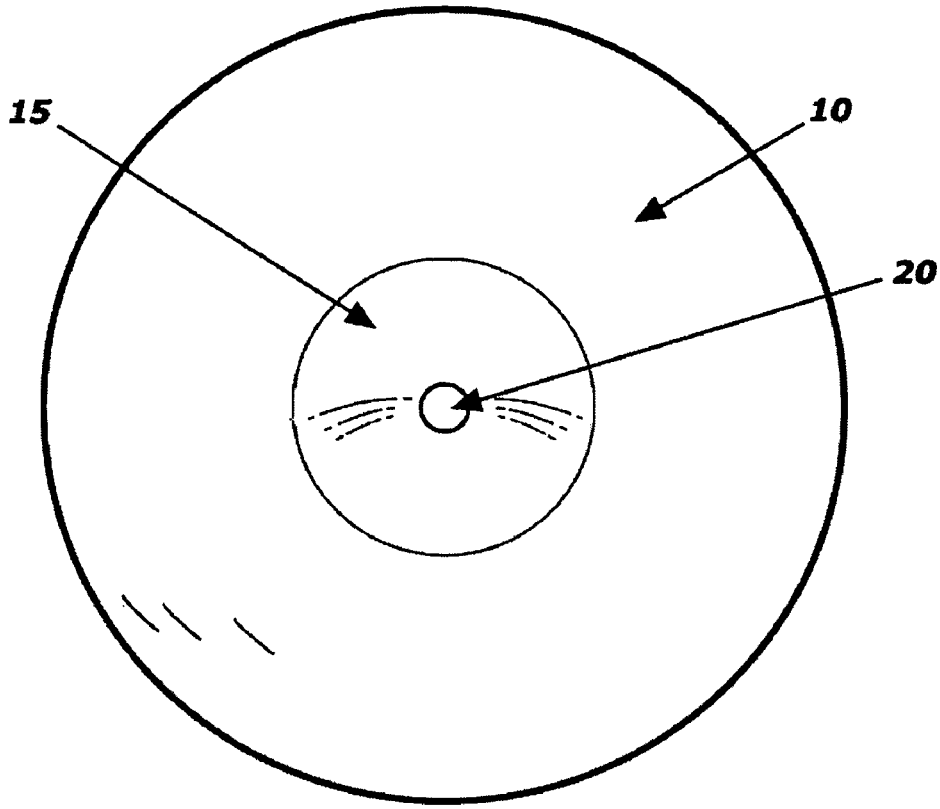
FIG. 3 is a top view of the cymbal muting system.

FIG. 3 shows a top view of the cymbal 10 with the center hole 20 and the bell 15. As you can see from this view, the muting system comprised of the clear PVC ring layer is not visible as it is bonded to the underside.

Figure 4:
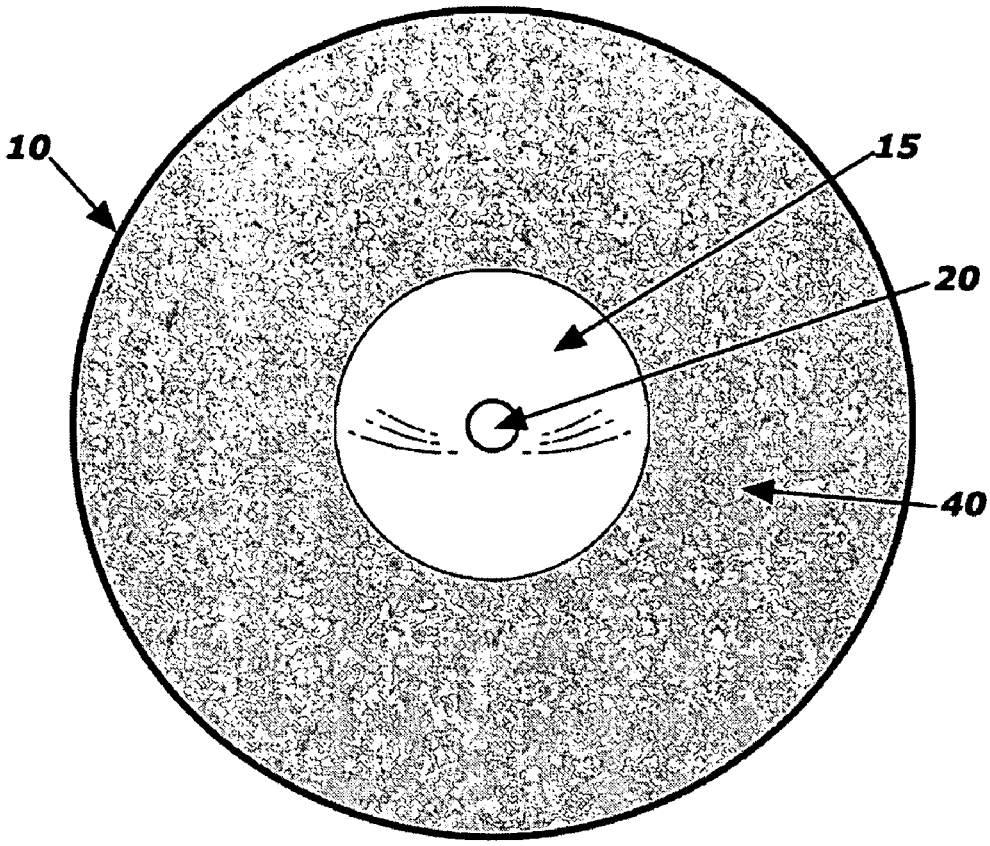
FIG. 4 is a bottom view of the cymbal muting system.

FIG. 4 shows a bottom view of the cymbal 10 with the hole 20 and the bell 15. From this bottom view you can see that the PVC ring 40 covers the underside of the cymbal 10, except for the bell 15. The PVC ring 40, being comprised of a clear PVC material, allows the natural surface and color of the cymbal 10 to be visible.

Figure 5:
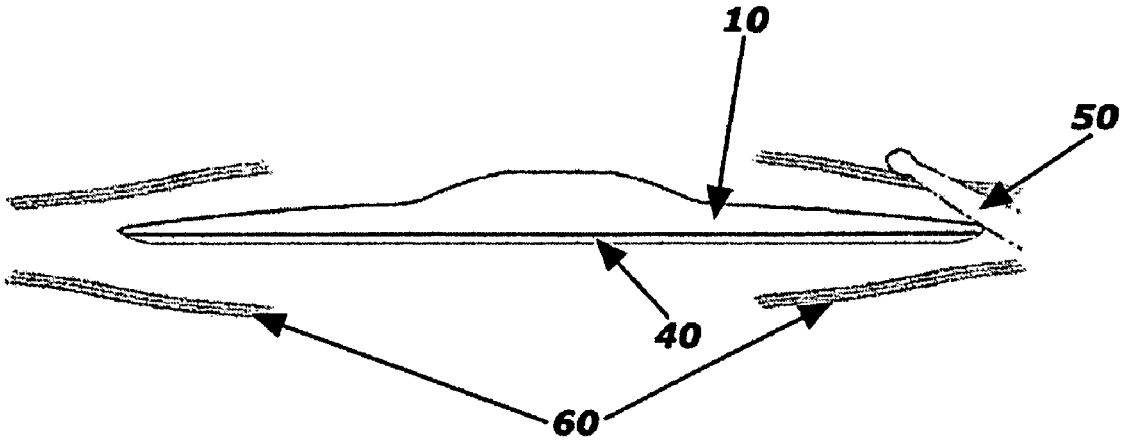
FIG. 5 is a side view of the cymbal muting system, showing reduced vibrations of the cymbal instrument.

FIG. 5 shows how the PVC material 40 acts as a vibration dampening system by minimizing vibrations 60 of the cymbal 10, when it is struck with a stick 50.

Figure 6:
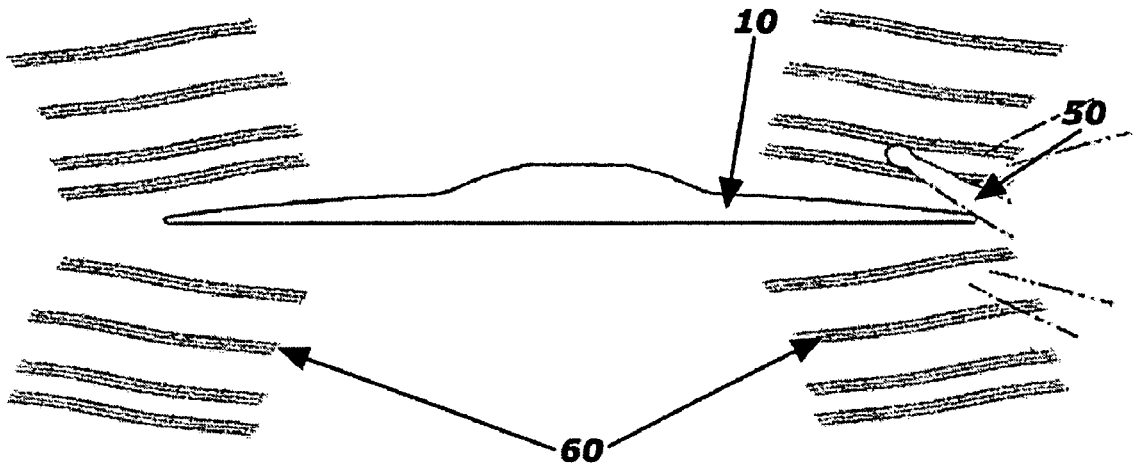
FIG. 6 is a side view of the prior art, showing the normal vibrations of the cymbal instrument.

FIG. 6 shows the prior art for a comparison of how the cymbal 10 will cause more vibrations 60 without the PVC ring layer, when it is struck with the stick 50. An experiment was conducted to measure the sound pressure level of a cymbal without a dampening layer versus the same cymbal with the dampening layer. The cymbal without the dampening layer was measured at 88 dB from a distance of one foot with a C weighted sound pressure level meter. The same cymbal with the dampening layer applied measured 72 dB from the same distance, using the same meter and meter settings.

While the preferred embodiment has been described, my invention could be produced using slightly different components and options. For example:

Although most metal cymbals are made from a brass or bronze alloy, any material that vibrates could be used to make the cymbal.

Although the cymbal used in my invention contains a bell, the bell is not required and cymbals without a bell may be used.

Although the PVC layer's outside diameters is the same as the cymbal's diameter, a different outside diameter could be used for either the cymbal or PVC layer.

Although the inside dimension of the PVC ring matches the diameter of the cymbal's bell, the inside dimension of the PVC ring could be any size as long as it does not obstruct the cymbal's center mounting hole.

Although the PVC layer and cymbal are in the shape of a circle, any shape cymbal and any shaped PVC layer may be used.

Although the round striking surface of the cymbal is superior, any shaped striking surface for the cymbal may be used.

Although a clear acrylic pressure sensitive adhesive is a superior permanent bonding method, several methods of permanent, semi-permanent, or temporary adhesion means could be utilized to bond the PVC layer to the cymbal including epoxy, tape, rivets, screws, double sided adhesive tape, or glue.

Although the preferred embodiment mounting of the clear PVC layer to the bottom (i.e., second) surface of the cymbal is generally superior because it does not change the top (i.e., playing) surface, mounting the PVC layer to the top is also possible.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A device for muting a cymbal, said cymbal having a first or playing surface, being the surface which is struck when the cymbal is played, and a second surface, and having a center mounting hole, comprising:

a ring of flexible dampening layer adhesively attached to the second surface so as to reduce the vibratory response of said cymbal to being struck;

wherein said ring has an inside diameter D1 and an outside diameter D2, and wherein the diameter D1 is no smaller than said cymbal's center mounting hole and the diameter D2 is no larger than the outside diameter of said cymbal.

* * * * *